US005992544A

United States Patent [19]

Sprehe

[11] Patent Number: 5,992,544

[45] Date of Patent: Nov. 30, 1999

[54] FIRE SUPPRESSION APPARATUS FOR WELL DRILLING SYSTEM

[76] Inventor: Paul Robert Sprehe, 134 Bertel Dr., Covington, La. 70433

[21] Appl. No.: 09/280,800

[22] Filed: Mar. 26, 1999

Related U.S. Application Data

[63] Continuation-in-part of application No. 08/772,697, Dec. 23, 1996, Pat. No. 5,890,549.

[51] Int. Cl.[6] ..... E21B 21/06

[52] U.S. Cl. ..... 175/208; 175/207; 166/90.1; 169/69

[58] Field of Search ..... 166/90.1; 175/206, 175/207, 208, 209, 212; 169/69

[56] References Cited

U.S. PATENT DOCUMENTS

| | | | |
|---|---|---|---|
| 1,640,838 | 8/1927 | Kliewer | 166/90.1 |
| 1,847,864 | 3/1932 | Cross | 175/88 X |
| 2,000,381 | 5/1935 | Duffy | 166/90.1 |
| 3,417,830 | 12/1968 | Nichols | 175/209 |
| 3,943,997 | 3/1976 | Davis | 166/312 |
| 4,316,506 | 2/1982 | Poole | 169/69 |
| 4,363,357 | 12/1982 | Hunter | 175/209 X |
| 4,899,827 | 2/1990 | Poole | 169/69 |
| 5,775,442 | 7/1998 | Speed | 175/212 X |

OTHER PUBLICATIONS

Condon, William S. et al., "Electronic pressure Detection Improves Drilling Operations," World Oil, Mar. 1996 (best available copy).

Williams Tool Co., Inc. product data, Rotating Blowout Preventer Systems, date unknown.

Shale, Les, "Underbalanced Drilling With Air Offers Many Pluses", Oil & Gas Journal, Jun. 26, 1995, pp. 33–39.

Hannegan, Don, "Applications widening for rotating control heads", Drilling Contractor, Jul. 1996, pp. 17–19 (best avaiable copy).

Bourgoyne, Jr., Adam T., "Rotating control head applications increasing", Louisiana State University, Oil and Gas Journal, Oct. 9, 1995 (best available copy).

Tangedahl, Michae J.; Stone, Charles R. (Rick), "Rotating preventers: Technology for better well control", World Oil, Oct. 1992, pp. 63–64, 66.

Churcher, P.L.; Yurkiw, Fred J.; Bietz, Ron F.; Bennion, D. Brant; "Properly designed underbalanced drilling fluids can limit formation damage", Oil & Gas Journal, Apr. 29, 1996, pp. 50–56.

Butler, S.D.; Rashid, A.U.; Teichrob, R.R., "Monitoring downhole pressures and flow rates critical for underbalanced drilling", Oil & Gas Journal, Sep. 16, 1996, pp. 31–39.

Nicolson, K.M., "Air and Gas Drilling", Standard Oil Company of California publication, date unknown, pp. 149–155.

Lagendyk, R.; Loring, G. and Aasen, J., "Drilling applications expand snubbing unit use," World Oil, May 1996, pp. 37–44.

Duda, John R., "Strong growth projected for underbalanced drilling," Oil & Gas Journal Special, pp. 67–77, Sep. 23, 1996.

Yee,Stewart; Comeaus, B. and Smith, R., "Recent Advances in Underbalanced Horizontal Drilling," Sperry–Sun Drilling Services, pp. 1–7, 9 Figures, copyright, 1995.

*Primary Examiner*—Hoang Dang

*Attorney, Agent, or Firm*—Akin, Gump, Strauss, Hauer & Feld

[57] ABSTRACT

In a well drilling system a fire suppression apparatus includes a pressure rated bell nipple or enclosure member mounted on the blowout preventer and including an elongated central passage opening at one end to an enlarged bore portion adjacent a restabbing flange. Diametrically opposed convergent nozzles open into the enlarged bore portion and are connected to a source of pressure water and/or a source of pressure fire extinguishing fluid by way of a manifold and respective remotely controllable shut off valves and check valves. The enclosure replaces a conventional bell nipple and provides an added measure of fire suppression protection in the event of uncontrolled flow of well fluids from the well. Branch conduit sections are connected to the main conduit section of the enclosure to provide a cuttings evacuation fluid flow line and a fill up or well fluid diversion line.

20 Claims, 1 Drawing Sheet

FIRE SUPPRESSION APPARATUS FOR WELL DRILLING SYSTEM

CROSS REFERENCE TO RELATED APPLICATION

This application is a continuation in part of U.S. patent application Ser. No. 08/772,697, filed Dec. 23, 1996, now U.S. Pat. No. 5,890,549.

FIELD OF THE INVENTION

The present invention pertains to a fire suppression apparatus for a well drilling system including a drill cuttings evacuation fluid conduit member with an enlarged bore portion and fire extinguishing fluid injector nozzles opening into the enlarged bore portion for preventing or extinguishing combustion of well fluids flowing from an uncontrolled well.

BACKGROUND

My above identified patent is directed to a well drilling system which includes a drill cuttings evacuation fluid conduit member or enclosure, sometimes referred to as a "bell nipple", adapted to include an array of fire suppression fluid injector nozzles to minimize ignition of well fluids in an uncontrolled well. The enclosure or well fluids conduit member of the above-referenced patent includes an array of at least three injector nozzles connected to a source of pressure water and/or pressure fire extinguishing material which may be injected into the enclosure to minimize combustion of well fluids which may result from a well which becomes at least temporarily out of control and combustible fluids are allowed to flow and commingle with drill cuttings evacuation fluid being returned from the wellbore. However, in the further development of a suitable system for minimizing the combustion of well fluids or to extinguish combustion of well fluids emanating from a wellbore during drilling operations or the like, it has been determined that certain improvements are desired.

For example, due to the substantial pressure of fluids emanating from an uncontrolled well through the drill cuttings evacuation fluid flowpath, it is desirable to reduce the fluid pressure so that the fire extinguishing fluids may flow freely into and commingle with combustible well fluids to minimize the chance of combustion or to extinguish a flow stream which has already become ignited. Moreover, in accordance with the arrangement in the above-mentioned patent, it is desirable to locate the injector nozzles for the fire extinguishing or suppressing fluids in a position downstream or "above" the location of any branch conduits of the enclosure or bell nipple, such as conduits which allow for fill up of the wellbore, diversion of wellbore fluids and conduits which conduct drill cuttings evacuation fluids away from the well.

Still further, it is desirable to provide a cuttings evacuation fluid enclosure, or so-called bell nipple or "spool", which includes a transverse flange formed at the top end thereof to assist in attaching well control devices if an out of control well condition exists. Moreover, it has been determined that an array of two diametrically opposed fluid injection nozzles is preferable to the provision of additional nozzles in the array so as to provide a more even distribution of flow of fire extinguishing materials through the nozzles and into the space where uncontrolled well fluids are flowing. It is also desirable to provide control valves associated with the fire extinguishment or suppression fluid injector nozzles which provide for positive remote control of flow of fire extinguishment fluids.

It is to the above-mentioned ends, as well as providing other desiderata in fire suppression apparatus for use with drilling hydrocarbon wells, in particular, that the present invention is directed.

SUMMARY OF THE INVENTION

The present invention provides an improved apparatus for use in a well drilling system to minimize the onset of or to suppress combustion of well fluids emanating from a wellbore in a well which is at least partially out of control.

In accordance with one important aspect of the invention, a so-called bell nipple or tubular enclosure member is provided for inclusion in the well structure and which is provided with a first passage for conducting drill cuttings evacuation fluid from the wellbore and for conducting fluids to the wellbore during a fill-up procedure, which passage includes an enlarged bore portion and an array of opposed fire suppression fluid injector nozzles opening into the enlarged bore portion to substantially assure flow of fire suppression or extinguishment fluid under substantially all flow conditions which might exist in an uncontrolled well. The opposed injector nozzles are desirably inclined at an acute angle with respect to the central longitudinal axis of the enclosure member and are oriented to inject fire extinguishment fluid into the enclosure in a direction generally corresponding to the direction of flow of fluids from the wellbore.

In accordance with another aspect of the invention, a so-called bell nipple or enclosure member is provided for use in a well drilling system which includes a central axially extending conduit section and a transverse branch conduit section forming a main flowpath or passage for conducting the flow of drill cuttings evacuation fluid away from the member and at least a second branch conduit section opening to the main conduit section for diverting wellbore fluids therethrough or for use in filling the wellbore with cuttings evacuation or kill fluids, for example.

Still further, in accordance with the invention, there is provided a fire suppression apparatus for use in conjunction with a well drilling system which includes plural fire suppression fluid injector nozzles arranged thereon and connected to a source or sources of fire extinguishment fluid by way of respective check valves which are interposed in a flowpath leading to the injector nozzles, and further wherein remotely controllable shutoff valves are interposed between the check valves and the fluid injector nozzles.

The above-mentioned fire suppression apparatus or system provides several advantages. The fire suppression fluid injection nozzles are positioned above or downstream of the flowpath for drill cuttings evacuation fluid and also downstream or above a flowpath for diversion of well fluids or for conducting well fluids into the wellbore from another source. Two diametrically opposed fluid injection nozzles are provided and preferably inclined at an angle of about 30° from the longitudinal axis of the enclosure member. An enlarged bore portion of the bell nipple or enclosure member into which the injector nozzles open is arranged to create an eductor effect to reduce pressure in the enclosure main flow passage and to assure the flow of fire extinguishing fluid to mix with well fluids which are leaving the well in a generally uncontrolled manner. A transverse restabbing flange is provided on the enclosure member for receiving well control apparatus used for bringing an uncontrolled well back under flow control and containment of a well flowstream. The bell nipple or enclosure member is adapted to be connected to full opening remotely controllable shut-off valves or so-called block valves interposed the nozzles and a manifold connected to a source of fire suppression or extinguishment fluids. Full opening check valves are interposed the remotely controllable shut-off valves and the fire extinguishing fluid manifold.

Those skilled in the art will further appreciate the advantages and superior features of the invention upon reading the detailed description which follows in conjunction with the drawing.

DETAILED DESCRIPTION OF A PREFERRED EMBODIMENT

Figure 1:
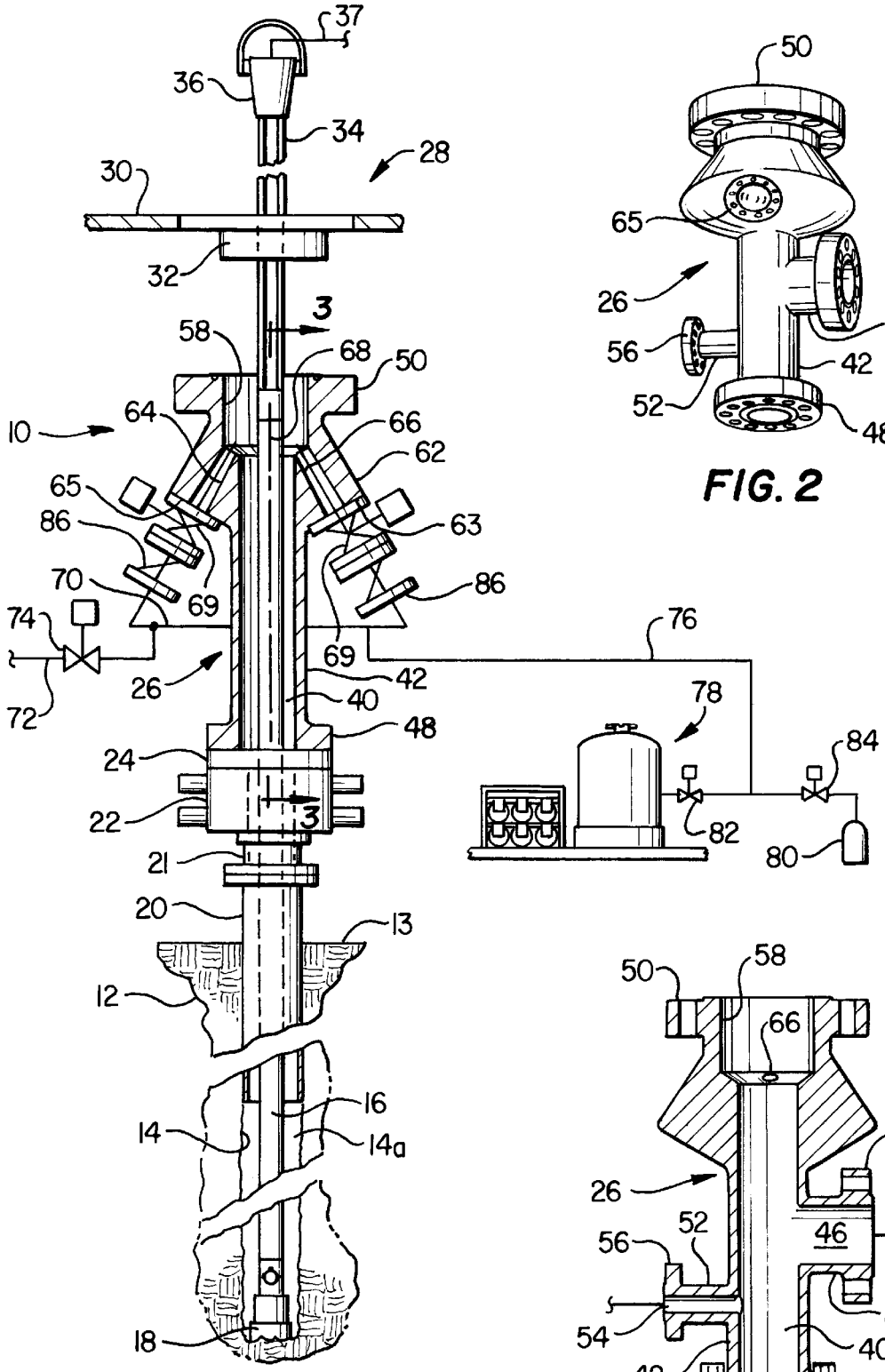
FIG. 1 is a somewhat schematic diagram of part of a well drilling system and illustrating the improved fire suppression apparatus of the present invention.

In the description which follows, like parts are marked throughout the specification and drawing with the same reference numerals, respectively. The drawing figures are not necessarily to scale and certain features may be shown exaggerated in scale or in somewhat schematic form in the interest of clarity and conciseness. The subject matter of U.S. Pat. No. 5,890,549, issued Apr. 6, 1999, is incorporated herein by reference.

Referring to FIG. 1, there is illustrated a well drilling system including a fire suppression apparatus in accordance with the invention and generally designated by the numeral (10). The well drilling system (10) includes several conventional elements adapted for drilling a well in an earth formation (12) wherein a wellbore (14) is being formed by an elongated tubular drill stem (16) including a conventional drill bit (18) connected to the lower distal end thereof. The wellbore (14) is at least partially fitted with a conventional casing (20) extending above the earth's surface (13) and having supported thereon a conventional wellhead structure (21) which may include a blow-out preventer (22). The blow-out preventer (22) may be one of several types commercially available including an annular or opposed ram type preventer, for example.

Figure 2:
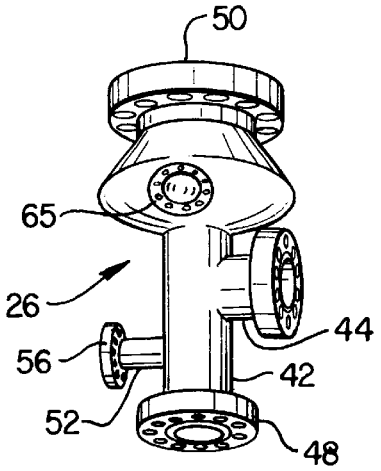
FIG. 2 is a perspective view of the bell nipple or enclosure member of the fire suppression apparatus.
Figure 3:
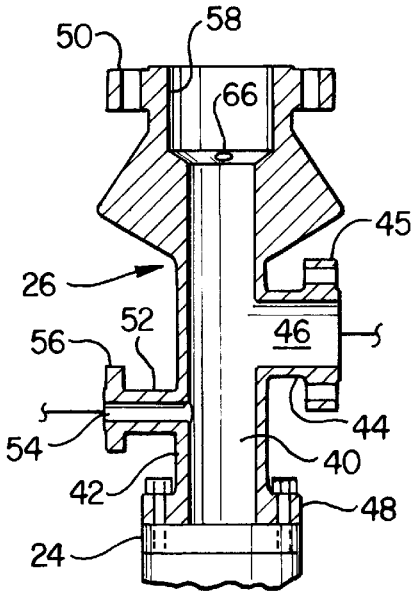
FIG. 3 is a longitudinal section view taken generally along the line 3—3 of FIG. 1.

The blow-out preventer (22) is provided with a conventional transverse circular mounting flange (24) on which is mounted an elongated substantially tubular enclosure member, generally designated by the numeral (26), and sometimes referred to as a so-called bell nipple or spool member. The enclosure (26) is also illustrated in FIGS. 2 and 3. A portion of a conventional well drilling rig (28) is illustrated in FIG. 1, including a floor (34) supporting a conventional rotary table (32) through which extends a rotary drive member or kelly (34) which is suitably connected to the drill stem (16) in a conventional manner. A swivel member (36) is operably connected to the kelly member (34) and to a source of drill cuttings evacuation fluid or "mud," not shown, by way of a conduit (37). Drill cuttings evacuation fluid is conducted through the conduit (37), the kelly or drive member (34), down through the tubular drill stem (16) and the bit (18) for flow into the wellbore 14. Drill cuttings are evacuated through the wellbore annulus 14*a* formed by the drill stem (16) for flow upward into the enclosure (26) including flow into a passage (40), FIG. 1, formed by a main conduit section (42) of the enclosure. Drill cuttings evacuation fluid is conducted out of the passage (40) through a branch conduit section (44), FIGS. 2 and 3, forming a branch flow passage (46) to suitable cuttings evacuation fluid treatment equipment, not shown. Alternatively, the enclosure (26) may be connected to a drill cuttings treatment and control system as described in my U.S. Pat. No. 5,890,549.

Referring further to FIGS. 1, 2 and 3, the enclosure or bell nipple (26) includes a lower transverse flange (48) for mounting the enclosure on the flange (24) of the blow-out preventer (22) and an upper transverse or so-called restabbing flange (50) at the opposite end of the enclosure. As shown in FIGS. 2 and 3, a second branch conduit section (52) extends transversely from the conduit section (42) and includes a flow passage (54) formed therein. A suitable connecting flange (56) is provided for the conduit section (52) and a connecting flange (45) is provided for the conduit section (44). The conduit section (52) may be used as a so-called fill-up line for adding drilling fluid to the wellbore (14) or may serve to divert flow of fluids out of the passage (40) under certain drilling conditions.

As shown in FIGS. 1 and 3, the enclosure (26) includes an enlarged bore portion (58) at the so-called top end of the enclosure and adjacent the flange (50) and which is in fluid flow communication with the conduit section (42) and the passage (40). As shown in FIG. 1, the enclosure (26) is provided with an enlarged diameter portion (62) of the conduit section (42) and which is provided with two diametrically opposed converging nozzles (64) and (66) formed therein and which open into the enlarged bore or passage portion (58). The nozzles (64) and (66) are inclined at an angle of about 30° to the longitudinal central axis 68 of the enclosure (26). The enlarged diameter portion (62) is also provided with two opposed mounting faces (63) and (65) for mounting remotely controllable shut-off valves (69) thereon, respectively, as shown in FIG. 1. The remotely controllable shut-off valves (69) may be of a type commercially available, such as hydraulically or electrically actuated API (American Petroleum Institute) pressure rated FL Series block valves sold by Cooper Cameron Corporation of Houston, Tex. The block valves (69) are operably connected to a common arcuate manifold (70) which, in turn, is connected to a source of pressure water by way of a conduit (72) and a remotely controllable shut-off valve (74). The manifold (70) is also connected by way of a conduit (76) to a source of fire extinguishing fluid, generally designated by the numeral (78). As described in my U.S. Pat. No. 5,890,549, the source of fire extinguishing fluid may be a conventional dry chemical fire extinguishing unit, such as a type supplied by Ansul Fire Protection Division of Wormald U.S., Inc. of Marinette, Wis. as one of their skid-mounted dry chemical systems of the S-3000 series, for example. Additionally, a small reservoir (80) of fire extinguishing fluid may be connected to conduit (76) for testing operability of the apparatus illustrated in FIG. 1, from time to time. Remotely controllable valves (82) and (84) are provided for discharging fire extinguishing fluid to the manifold (70).

As illustrated in FIG. 1, a part of the fire extinguishing or suppression apparatus for conducting fire extinguishing fluid to the nozzles (64) and (66) includes API pressure rated full opening check valves (86) interposed the block valves (69) and the manifold (70). In this way, backflow of well fluid into the manifold (70) is prevented in the event that the so-called block or shut-off valves (69) remain in an open position. The check valves 86 may be of a type commercially available such as MS Series valves manufactured by Cooper Cameron Corporation. The manifold (70) is preferably a semi-circular member extending between the check valves (86) and suitably connected to the conduits (72) and (76) to provide pressure water and/or fire extinguishing fluid, as needed. Since each of the valves (69), (74), (82) and (84) are remotely controllable, should a fire hazard exist due to a well condition wherein the flow of well fluids through the passage (40) and the enlarged bore portion (58) is somewhat uncontrolled, pressure water and/or fire extinguishing fluid may be injected directly into the fluid flowstream emanating from the bore (58) to minimize or extinguish combustion and prevent damage to the drill rig (28), including the rotary table (32) and the rig floor (30). It should be noted that the specific configuration of the drill rig (28) may vary without affecting the advantages of using the fire suppression apparatus including the enclosure (26) of the present invention. The particular rig may be a top drive type rig, for example, instead of a rotary table configuration as shown and described.

The operation of the fire suppression apparatus or system of the invention is believed to be readily understandable to those of ordinary skill in the art from the foregoing description and from reading the specification of U.S. Pat. No. 5,890,549. By providing the nozzles (64) and (66) opening into an enlarged bore portion (58) of the passage (40), flowing well fluid will create an eductor effect which will aid in discharging fire extinguishing fluids through the nozzles 64 and 66. By inclining the nozzles 64 and 66 upwardly at an angle of 30° to the axis 68, for example, this aids in directing fire extinguishing fluids in the proper direction and also aids in the eductor effect created by the fluid flowing past the nozzles which open into the enlarged bore (58).

The flange (50) is advantageous in that, should a well blow-out or uncontrolled flow of well fluids occur, containment structure may be brought into position and mounted on the flange when required. Moreover, it has been determined that, providing a single manifold (70) for discharging fire extinguishing fluid to only two diametrically opposed nozzles, the conduction of fluid entrained powder-type fire extinguishing materials is more effectively and evenly distributed than if a greater or lesser number of nozzles is used.

As with the system described in U.S. Pat. No. 5,890,549, by providing the nozzles (64) and (66) arranged in a so-called downstream position from the branch conduits (44) and (52) of the enclosure (26), the arrangement provides for greater control over the flow of drill cuttings evacuation fluid or so-called drilling "mud." Still further, by providing the remotely controllable shut-off or so-called block valves (69) upstream of the nozzles (64) and (66), improved control over flow of fluids through the enclosure (26) is provided. The check valves (86) also allow the shut-off valves (69) to remain open during drilling operations, yet in the case of a so-called "blow-out" or loss of control of the well, the block valves (69) may be closed once a recapping operation has reestablished control of the well stream. Check valves alone, cannot be relied on to contain pressure during a restabbing operation to control an out of control well stream. To be operable and reasonably safe in all ranges of loss of control conditions, the enclosure (26) should incorporate the enlarged bore portion (58) at the upper end as indicated in FIG. 1 and with the nozzles (64) and (66) inclined to direct the stream of fire extinguishing fluid and/or water vertically up into the blowing stream of well fluid and above the branch conduits (44) and (52).

Although the configuration of the fire suppression apparatus for a well drilling system described herein does not require a rotary seal as described in my U.S. Pat. No. 5,890,549, the enclosure (26) may be used in conjunction with the system described in the patent in place of the enclosure shown therein.

The fabrication and operation of the fire suppression apparatus and the well drilling system described above is believed to be within the purview of one of ordinary skill in the art of well drilling equipment and fire suppression apparatus used in conjunction with hydrocarbon wells. The enclosure (26) may be formed of forged or cast steel or machined from bar stock using conventional engineering materials associated with high pressure equipment used in well drilling systems and the like. Preferably, the enclosure (26) is fabricated in accordance with API Specification No. 6A for a 5,000 psig rated working pressure, for example.

Although a preferred embodiment of the present invention has been described in detail hereinabove, those skilled in the art will recognize that various substitutions and modifications may be made to the enclosure (26) and the associated fire suppression apparatus for the well drilling system described without departing from the scope and spirit of the appended claims.

What is claimed is:

1. In a system for drilling a well including an elongated drill stem extendable into a wellbore penetrating an earth formation and a wellhead operably connected to said wellbore for receiving said drill stem extending therethrough and including means forming a circulation path for drill cuttings evacuation fluid circulated through said drill stem and through an annulus of said wellbore, the improvement characterized by:

an enclosure member supported on said wellhead and disposed in said circulation path and including a conduit section forming a first passage, a branch conduit section intersecting said main conduit section and forming a second passage for conducting cuttings laden evacuation fluid away from said first passage and an enlarged bore portion of said first passage extending generally above said branch conduit section;

plural nozzles on said enclosure member and opening into said enlarged bore portion of said first passage, said nozzles being inclined in a direction toward well structure disposed adjacent said enclosure member and in a direction of flow of cuttings evacuation fluid and wellbore fluids through said enclosure member in the event of uncontrolled flow of fluids from said wellbore;

conduit means connected to each of said nozzles; and a source of fire extinguishing fluid operably connected to said conduit means for discharging fire extinguishing fluid into the flowpath of well fluids flowing through said enclosure member to suppress combustion of said well fluids.

2. The improvement set forth in claim 1 wherein:

said conduit means comprises a manifold connected to each of said nozzles.

3. The improvement set forth in claim 2 including:

remotely controllable shutoff valves interposed said nozzles, respectively, and said manifold.

4. The improvement set forth in claim 3 including:

check valves interposed, respectively, said shutoff valves and said manifold to prevent flow of fluid from said nozzles into said manifold, respectively.

5. The improvement set forth in claim 1 including:

a restabbing flange on said enclosure member at one end thereof and delimited by said enlarged bore portion.

6. The improvement set forth in claim 1 wherein:

said enclosure member includes two diametrically opposed nozzles.

7. The improvement set forth in claim 6 wherein:

said nozzles are convergent nozzles.

8. The improvement set forth in claim 7 wherein:

said nozzles are inclined at an acute angle with respect to a longitudinal central axis of said enclosure member.

9. The improvement set forth in claim 1 wherein:

said conduit means is connected to a source of pressure water and to a source of fire extinguishing fluid, respectively.

10. In a system for drilling a well including an elongated drill stem extendable into a wellbore penetrating an earth formation and a wellhead operably connected to said wellbore for receiving said drill stem extending therethrough and including means forming a circulation path for drill cuttings evacuation fluid circulated through said wellbore, the improvement characterized by:

an enclosure member supported on said wellhead and disposed in said circulation path and including a conduit section forming a first passage, a branch conduit section intersecting said main conduit section and forming a second passage for conducting cuttings laden evacuation fluid away from said first passage and an enlarged bore portion of said first passage extending generally above said branch conduit section;

diametrically opposed nozzles on said enclosure member and opening into said first passage, said nozzles being inclined at an acute angle with respect to a longitudinal axis of said first passage and in a direction toward well structure disposed adjacent said enclosure member and in a direction of flow of cuttings evacuation fluid and wellbore fluids through said enclosure member in the event of uncontrolled flow of fluids from said wellbore; and conduit means connected to each of said nozzles and to a source of fire extinguishing fluid for discharging said fire extinguishing fluid into the flowpath of well fluids flowing through said enclosure member to suppress combustion of said well fluids.

11. The improvement set forth in claim 10 wherein:

said conduit means comprises a manifold connected to each of said nozzles.

12. The improvement set forth in claim 11 including:

remotely controllable shutoff valves interposed said nozzles, respectively, and said manifold.

13. The improvement set forth in claim 12 including:

check valves interposed, respectively, said shutoff valves and said manifold to prevent flow of fluid from said nozzles into said manifold, respectively.

14. The improvement set forth in claim 10 including:

a restabbing flange on said enclosure member at one end thereof and delimited by said enlarged bore portion.

15. The improvement set forth in claim 10 wherein:

said nozzles are convergent nozzles.

16. The improvement set forth in claim 10 wherein:

said nozzles are inclined at an angle of about 30 degrees with respect to a longitudinal central axis of said first passage.

17. In a system for drilling a well including an elongated drill stem extendable into a wellbore penetrating an earth formation and a wellhead operably connected to said wellbore for receiving said drill stem extending therethrough and including means forming a circulation path for drill cuttings evacuation fluid circulated through said wellbore, the improvement characterized by:

an enclosure member disposed in said circulation path and including a conduit section forming a first passage, a branch conduit section intersecting said main conduit section and forming a second passage for conducting cuttings laden evacuation fluid away from said first passage;

plural nozzles on said enclosure member and opening into said first passage, said nozzles being inclined at an acute angle with respect to a longitudinal axis of said first passage and in a direction toward well structure disposed adjacent said enclosure member and in a direction of flow of cuttings evacuation fluid and wellbore fluids;

conduit means connected to each of said nozzles and to a source of fire extinguishing fluid for discharging fire extinguishing fluid into the flowpath of well fluids flowing through said enclosure member to suppress combustion of said well fluids;

remotely controllable shutoff valves interposed said nozzles, respectively, and said conduit means; and check valves interposed, respectively, said shutoff valves and said conduit means to prevent flow of fluid from said nozzles into said conduit means.

18. The improvement set forth in claim 17 wherein:

said conduit means comprises a manifold connected to each of said nozzles.

19. The improvement set forth in claim 17 including:

a restabbing flange on said enclosure member at one end thereof and delimited by an enlarged bore portion of said first passage.

20. The improvement set forth in claim 17 wherein:

said enclosure member includes two diametrically opposed convergent nozzles and said nozzles are inclined at an angle of about 30 degrees with respect to a longitudinal central axis of said first passage.

* * * * *